US011383112B2

(12) United States Patent
Gonthier et al.

(10) Patent No.: US 11,383,112 B2
(45) Date of Patent: Jul. 12, 2022

(54) FIRE EXTINGUISHER

(71) Applicant: ARIANEGROUP SAS, Paris (FR)

(72) Inventors: Gilles Gonthier, Pessac (FR); Frédéric Marlin, St Medard en Jalles (FR)

(73) Assignee: ARIANEGROUP SAS, Paris (FR)

( * ) Notice: Subject to any disclaimer, the term of this patent is extended or adjusted under 35 U.S.C. 154(b) by 0 days.

(21) Appl. No.: 16/971,178

(22) PCT Filed: Feb. 18, 2019

(86) PCT No.: PCT/FR2019/050363

§ 371 (c)(1),
(2) Date: Aug. 19, 2020

(87) PCT Pub. No.: WO2019/162603

PCT Pub. Date: Aug. 29, 2019

(65) Prior Publication Data

US 2021/0101036 A1 Apr. 8, 2021

(30) Foreign Application Priority Data

Feb. 20, 2018 (FR) ..... 1851428

(51) Int. Cl.
*A62C 13/00* (2006.01)
*A62C 99/00* (2010.01)

(52) U.S. Cl.
CPC ..... *A62C 13/003* (2013.01); *A62C 99/0018* (2013.01)

(58) Field of Classification Search
CPC . A62C 13/003; A62C 35/023; A62C 99/0018; A62C 99/0027
USPC ..... 169/71–89, 30
See application file for complete search history.

(56) References Cited

U.S. PATENT DOCUMENTS 5,608,183 A 3/1997 Barnes et al.
6,143,102 A 11/2000 Mendenhall et al.
8,360,162 B2 * 1/2013 Lelic ..... A62C 99/0018 169/37

(Continued)

FOREIGN PATENT DOCUMENTS

FR 2 714 374 A1 6/1995
FR 2 772 370 A1 6/1999

(Continued)

OTHER PUBLICATIONS

International Search Report as issued in International Patent Application No. PCT/FR2019/050363, dated May 6, 2019.

(Continued)

*Primary Examiner* — Qingzhang Zhou
(74) *Attorney, Agent, or Firm* — Pillsbury Winthrop Shaw Pittman LLP

(57) ABSTRACT

A fire extinguisher includes a body defining a storage chamber containing an extinguishing agent, a gas generator configured to pressurize the extinguishing agent in order to dispense it outside the body through an exit opening. The exit opening is equipped with a misting nozzle, and the extinguishing agent has a solidification temperature less than −10° C., the saturating vapor concentration of the extinguishing agent taken at −10° C. and at 1 bar being less than the extinguishing concentration of the extinguishing agent determined according to the ISO 14520 standard for a heptane fire at 1 bar.

5 Claims, 2 Drawing Sheets

(56) References Cited

U.S. PATENT DOCUMENTS 9,713,732 B2 * 7/2017 Mitchell ..... A62C 3/08

FOREIGN PATENT DOCUMENTS

| | | | |
|---|---|---|---|
| FR | 2 866 022 | A1 | 8/2005 |
| FR | 2 891 822 | A1 | 4/2007 |
| FR | 2 892 117 | A1 | 4/2007 |
| FR | 2 899 227 | A1 | 10/2007 |
| FR | 2 902 783 | A1 | 12/2007 |
| FR | 2 915 746 | A1 | 11/2008 |
| FR | 2 950 624 | A1 | 4/2011 |
| FR | 2 964 656 | A1 | 3/2012 |
| FR | 2 975 097 | A1 | 11/2012 |
| WO | WO 2009/056574 | A1 | 5/2009 |
| WO | WO 2010/071622 | A1 | 6/2010 |
| WO | WO 2014/007862 | A2 | 1/2014 |

OTHER PUBLICATIONS

Search Report as issued in French Patent Application No. 1851428, dated Nov. 7, 2018.

* cited by examiner

FIRE EXTINGUISHER

CROSS-REFERENCE TO RELATED APPLICATIONS

This application is the U.S. National Stage of PCT/FR2019/050363, filed Feb. 18, 2019, which in turn claims priority to French patent application number 1851428 filed Feb. 20, 2018. The content of these applications are incorporated herein by reference in their entireties.

The present invention relates to a fire extinguisher comprising an extinguishing agent with a low saturating vapor pressure.

BACKGROUND OF THE INVENTION

Extinguishing fires in a low-temperature environment, i.e. extinguishing at a temperature less than or equal to −10° C., is a problem encountered in particular in the aeronautical field, for example when it is desired to extinguish a fire in the nacelle of an aircraft.

Halons (particularly Halon 1301-$CBrF_3$) are currently used as extinguishing agents to extinguish fires at these temperatures. Halons are halogenated chemical compounds containing bromine. The Halons have the advantage of having a high vapor pressure even when cold, allowing a higher gas concentration than the extinguishing concentration to be available even under low temperature conditions. For each extinguishing agent, the extinguishing concentration constitutes a quantity indicated by the supplier of this extinguishing agent. It indicates the minimal volume concentration of an extinguishing agent to be delivered into the atmosphere in order to extinguish a fire linked to the combustion of a given material. The extinguishing concentration is commonly evaluated according to the ISO 14520 standard by testing in a cup burner. The extinguishing concentration is given as a quantity independent of temperature.

However, Halons are polluting products, sources of ozone layer depletion, the use of which is subject to ever stricter regulatory prohibitions. Furthermore, it is expected that the Halons will no longer be available during the 2030s. The use of a Halon as an extinguishing agent therefore constitutes an unsatisfactory temporary solution from an environmental point of view, which it is desirable to replace.

In this regard, different extinguishing agents not having the detrimental effects of the Halons have been developed. Extinguishing agents of this type have a low saturating vapor pressure and are more respectful of the environment that the Halons. One example of an existing extinguishing agent with a low saturating vapor pressure is FK-5-1-12. It also bears the commercial name of Novec™ 1230. The extinguishing agents operate, with known extinguishing devices, by gasifying when leaving the spray nozzle to reach a sufficient gas concentration to allow the fire to be extinguished. At the present time, the manufacturer specifies a minimum use temperature below which the agent condenses before reaching this effective concentration, and therefore can no longer extinguish a fire. For example, for Novec™ 1230 the supplier indicates explicitly that his product is not usable at temperatures less than or equal to −10° C. Below this limiting use temperature, the concentration of saturated vapor of these extinguishing agents is less than their extinguishing concentration. In this case, the extinguishing agent sprayed in the gaseous state with known device is not present in a concentration sufficient for extinguishing the fire when the temperature is too low, hence the existence of this limiting use temperature.

It would therefore be desirable to have available a solution allowing extinguishing a fire at low temperature with an extinguishing agent, the saturating vapor pressure of which is less than its extinguishing concentration advertised by the manufacturer.

It would also be desirable to have available a fire extinguishing solution at low temperature that is more respectful of the environment than solutions involving the Halons.

OBJECT AND SUMMARY OF THE INVENTION

The object of the invention, according to a first embodiment, is a fire extinguisher comprising at least:

one body defining a storage chamber containing an extinguishing agent, one gas generator configured to pressurize the extinguishing agent in order to dispense it outside the body through an exit opening, the fire extinguisher being characterized in that the exit opening is equipped with a misting nozzle, and in that the extinguishing agent has a solidification temperature less than −10° C., the saturating vapor concentration of the extinguishing agent taken at −10° C. and at 1 bar being less than the extinguishing concentration of the extinguishing agent determined according to the ISO 14520 standard for a heptane fire at 1 bar.

By definition, the "saturating vapor concentration of the extinguishing agent taken at −10° C. and at 1 bar" is equal to the following ratio: [saturating vapor pressure of the extinguishing agent at −10° C.]/[1 bar].

The extinguishing concentration can be determined according to the ISO 14520 standard, 3$^{rd}$ edition, published in December 2015.

The invention also has as its object, according to a second embodiment, a fire extinguisher comprising at least:

one body defining a storage chamber containing an extinguishing agent, one gas generator configured to pressurize the extinguishing agent in order to dispense it outside the body through an exit opening, the fire extinguisher being characterized in that the exit opening is equipped with a misting nozzle, and in that the extinguishing agent has a solidification temperature less than −10° C. and a saturating vapor pressure less than or equal to 70 mbar at −10° C.

Hereafter, the expression "temperature less than or equal to −10° C." will be designated by "low temperature" unless otherwise stated.

The invention implements, in its two embodiments described above, an extinguishing agent with a low saturating vapor concentration at low temperature, with regard to the need for extinguishing.

The first embodiment has as its object extinguishing agents, with any saturating vapor pressure, for which the saturating vapor concentration at 1 bar and at −10° C. is less than the extinguishing concentration.

The second embodiment specifically has as its object extinguishing agents with a low saturating vapor concentration at −10° C. The extinguishing agents therefore have a low concentration of saturating vapor with regard to the need for extinguishing at low temperature.

In these two embodiments, an extinguishing agent therefore used, the employment of which in the gaseous phase is insufficient to accomplish the extinguishing of a fire at −10° C., or at temperatures less than −10° C.

Unlike known extinguishing devices, the extinguisher according to the invention implements a misting nozzle with allows generating a mist formed of small liquid droplets of the extinguishing agent during use. A misting nozzle constitutes a type of ejection nozzle known per se. In the presence of a flow of air (case of a cup burner or of airplane nacelles), the inventors have noted that fine liquid droplets were suitably transported toward the fire zone by the gas flow, at low temperature. It is advantageous that these droplets of the extinguishing agent are small, and therefore that a misting nozzle is used, because drops that are too large would be difficult to transport to the fire zone at low temperature, and may even risk forming a puddle right at the exit of the exit opening. Thus, by using a misting nozzle, the invention allows accomplishing the extinguishing below the limiting use temperature indicated by the manufacturer of the extinguishing agent because both the liquid phase (small droplets) and the gaseous phase of the extinguishing agent are transported toward the fire zone and participate in the extinguishing. Unlike current gaseous systems, extinguishing is ensured in the invention by a two-phase flow of the extinguishing agent prior to its contact with the fire zone.

The invention therefore supplies a solution for accomplishing the extinguishing of the fire at low temperature, while employing an extinguishing agent with a low saturating vapor concentration. This is a problem for which no suitable solution is currently proposed in the prior art, the use of extinguishing agents with a low concentration of saturating vapor at low temperature even being explicitly indicated as to be avoided by certain suppliers.

In addition to supplying a solution to the problem of extinguishing fire at low temperature, the inventors have noted that the extinguishing performance obtained at low temperature by means of the extinguisher according to the invention were particularly high, and in particular still higher than those obtained at higher temperature. This allows in particular using a smaller concentration for the extinguishing agent in order to extinguish a fire at low temperature, and therefore reducing the mass of the extinguisher.

In addition, relating specifically to the second embodiment, the use of an extinguishing agent with a low saturating vapor pressure is advantageous because it has low volatility, and therefore has a low impact on the environment.

In an exemplary embodiment, the ratio [density of the extinguishing agent]/[extinguishing agent–air surface tension] taken at the temperature of 20° C., is greater than or equal to 120,000 $s^2/m^3$.

A characteristic of this type allows reducing the size of the droplets formed and further increasing the quantity of extinguishing agent transported by the flow toward the fire at low temperature, thus improving the effectiveness of extinguishing.

In one exemplary embodiment, the extinguishing agent has a viscosity at −10° C. less than or equal to 2 centistokes.

A characteristic of this type is advantageous in order to reduce the pressure necessary for delivering a given flow rate of liquid agent, thus further facilitating the flow of extinguishing agent toward the fire zone.

In an exemplary embodiment, the gas generator is configured to impose a maximum pressure on the extinguishing agent greater than or equal to 3 bar, for example greater than or equal to 7 bar.

A characteristic of this type allows reducing the size of the droplets formed and further increasing the quantity of extinguishing agent transported by the flow toward the fire at low temperature, thus improving the effectiveness of extinguishing.

In one exemplary embodiment, the misting nozzle is capable of generating liquid droplets of extinguishing agent with a size less than or equal to 50 μm at −10° C.

A characteristic of this type advantageously allows, while using particularly small droplets, further improving the effectiveness of extinguishing at low temperature and thereby limiting the effective concentration for extinguishing the fire.

In particular, the misting nozzle can be capable of generating liquid droplets of extinguishing agent of a size less than or equal to 10 μm at −10° C.

In one exemplary embodiment, the gas generator comprises a pyrotechnic gas generator.

The use of a pyrotechnic gas generator is advantageous relative to the use of a bottle of pressurized gas in order, on the one hand, to limit the sensitivity to temperature of the pressure generated and, on the other hand, to obtain a quasi-constant profile of pressure imposed on the extinguishing agent as a function of time, thus further improving the effectiveness of extinguishing at low temperature.

Although the use of a pyrotechnic gas generator is preferred, for the gas generator to comprise a bottle of pressurized gas does not, however, depart from the scope of the invention.

In one exemplary embodiment, the gas generator is present in a pressurizing chamber separated from the storage chamber by a movable wall, the gas generator being configured to set the movable wall into motion in order to dispense the extinguishing agent outside the body. As a variant, the gas generator can be present in the storage chamber.

The invention also has as its object an aircraft equipped with an extinguisher as described above.

The invention also has as its object a method for extinguishing a fire in an environment with a temperature less than or equal to −10° C., comprising at least one step of dispensing the extinguishing agent by means of an extinguisher as described above.

In particular, the fire in question can be in an environment with a temperature less than or equal to −55° C.

BRIEF DESCRIPTION OF THE DRAWINGS

Other features and advantages of the invention will be revealed by the following description, given without limitation, with reference to the appended drawings, in which.

DETAILED DESCRIPTION OF EMBODIMENTS

Figure 1:
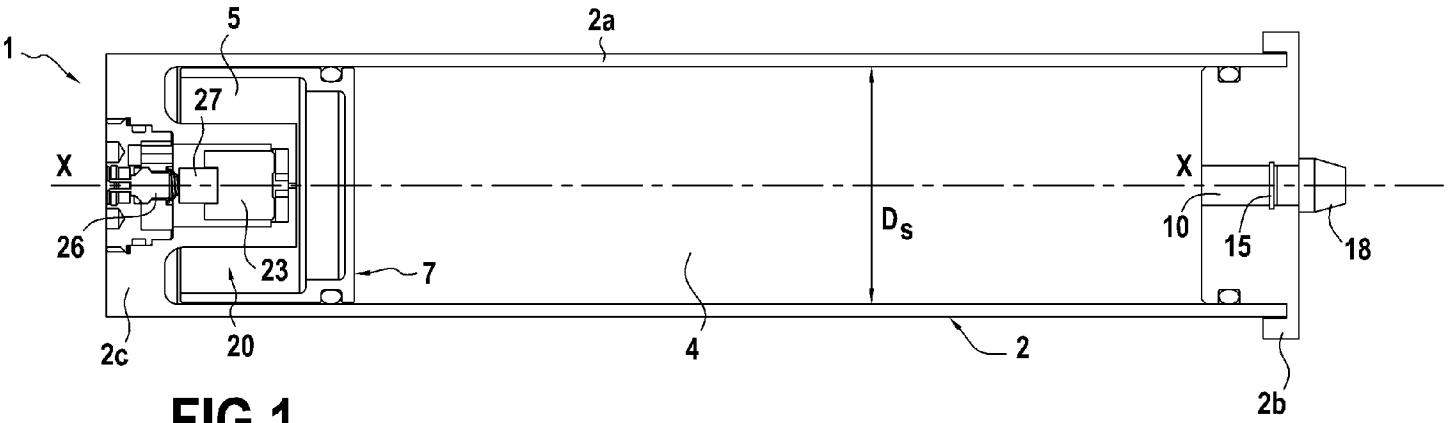
FIG. 1 shows schematically in longitudinal section and example of an extinguisher according to the invention.

Shown in FIG. 1 is an example of a fire extinguisher according to the invention.

The device 1 includes a body 2 extending along a longitudinal axis X and defining a storage chamber 4 in which an extinguishing agent (not shown) is present. The extinguishing agent can be present in the liquid state. In the case where the extinguisher is used at high temperature, the extinguishing agent can be in the gaseous state. Prior to the beginning of dispensing, the storage chamber 4 can have a non-zero free volume (i.e. a non-zero volume not occupied by the liquid medium containing the extinguishing agent). As a variant, the entire volume of the storage chamber is occupied by the liquid medium containing the extinguishing agent prior to the beginning of dispensing.

FK-5-1-12 or Novec™ 1230 (perfluoro-4-(trifluoromethyl)-3-pentanone) can be cited for example as examples of usable extinguishing agents.

In one exemplary embodiment, the extinguishing agent can have a saturating vapor pressure less than or equal to 70 mbar at −10° C. FK-5-1-12 in particular verifies this condition.

The extinguishing agent has a solidification temperature less than −10° C. It is thus in the liquid state when it is dispensed at −10° C. The solidification temperature of the extinguishing agent can in particular be less than or equal to −55° C. in certain extreme cases.

The extinguishing agent can have a viscosity at −10° C. less than or equal to 2 centistokes.

The body 2 also defines, in the example illustrated, a pressurization chamber 5 comprising a gas generator 20. In the example of FIG. 1, the gas generator 20 is a pyrotechnic gas generator. In a variant, not illustrated, the gas generator can be a cartridge of pressurized gas. The gas generator comprises at least one recess in which a pyrotechnic charge is present. More precisely, in the example illustrated in FIG. 1, the gas generator 20 includes an initiator 26 allowing initiating the combustion of the booster 27 which will trigger the combustion of the pyrotechnic charge 23 in order to generate the pressurizing gas. The pyrotechnic charge 23 can be in the form of a monolithic block or a granular material. The pyrotechnic charge 23 can have the same composition as the pyrotechnic charges typically used in the gas generators for airbags. The pyrotechnical load 23 has, however, dimensions suited to the intended operating duration (i.e. greater than those for pyrotechnic loads used in gas generators for airbags). Pyrotechnic compositions likely to be used in the gas generator 20 have in particular been described in the following documents: U.S. Pat. Nos. 5,608,183, 6,143,102, FR 2 975 097, FR 2 964 656, FR 2 950 624, FR 2 915 746, FR 2 902 783, FR 2 899 227, FR 2 892 117, FR 2 891 822, FR 2 866 022, FR 2 772 370 and FR 2 714 374. The gas generator can include one or more pyrotechnic charges. The gas generator 20 can be triggered electrically by the application of an electrical current to the terminals of the initiator, or mechanically (triggering by percussion). In the case of mechanical triggering, a firing pin strikes the firing device. In any case, the initiation of the firing device leads to the combustion of the pyrotechnic load 23 and to the liberation of gases arising from combustion.

During its actuation in a medium at a temperature less than or equal to −10° C., the gas generator can be configured to impose on the extinguishing agent a maximum pressure greater than or equal to 3 bar, to 7 bar for example. This maximum pressure can be comprised between 3 bar and 30 bar, for example between 7 bar and 30 bar. The general knowledge of a person skilled in the art is sufficient for designing a gas generator so as to allow the application of a desired maximum pressure value.

The pressurization chamber 5 is separated from the storage chamber 4 by a movable wall 7 in the example illustrated. The body 2 has, in the example illustrated, an axially symmetric shape, cylindrical here. Of course, the invention is not limited to shapes of this type for the body 2. The body 2 includes a lateral wall 2*a* extending along the longitudinal axis X of the body 2 and surrounding the storage chamber 4. The lateral wall 2*a* of the body 2 also surrounds the pressurization chamber 5. The body 2 also includes a first bottom wall 2*b* as well as a second bottom wall 2*c*. the first and second bottom walls 2*b* and 2*c* delimit longitudinally the body 2. The first bottom wall 2*b* delimits the storage chamber 4. The first bottom wall 2*b* has at least one exit opening 10 configured to deliver the extinguishing agent outside the body 2 during actuation of the gas generator 20. The second bottom wall 2*c* delimits the pressurization chamber 5. The pressurization chamber 5 is located between the movable wall 7 and the second bottom wall 2*c*. The storage chamber, for its part, is located between the first bottom wall 2*b* and the movable wall 7, the latter delimiting the storage chamber 4.

The movable wall 7 can be formed from a metallic material, aluminum for example. Advantageously, the movable wall 7 consists of a single material to further simplify the method of manufacture of the device 1. The movable wall 7 is configured to separate the storage chamber 4 from the pressurization chamber 5 in a sealed manner. The movable wall 7 is configured to communicate to the extinguishing agent present in the storage chamber 4 the pressure imposed by the gas generated in the pressurization chamber 5. The direction of application of the pressure by the movable wall 7 to the extinguishing agent to be dispensed is substantially parallel to the longitudinal axis X of the body 2. As illustrated, the movable wall 7 extends transversely, for example perpendicularly, relative to the longitudinal axis X of the body 2. The movable wall 7 extends over the entire internal diameter $D_s$ of the storage chamber 4. The movable wall 7 is configured to not be ruptured under the influence of the pressure imposed by the gas generated in the pressurization chamber 5.

The device 1 can also comprise a diaphragm 15 blocking in a sealed manner the exit opening 10 and configured to allow the departure of the extinguishing agent outside the body 2 when the pressure in the storage chamber 4 exceeds a predefined value. In other words, the diaphragm 15 is configured to prevent, when it is in a first configuration, the departure of the extinguishing agent outside the body 2; the diaphragm 15 is also configured to pass, in a second configuration when the pressure in the storage chamber 4 exceeds a predefined value, this second configuration of the diaphragm 15 allowing the departure of the extinguishing agent outside the body 2. The diaphragm 15 can, for example, be in form of a membrane configured to give way when the pressure in the storage chamber 4 exceeds a predefined value. In this case, the diaphragm 15 can, for example, be a membrane made of aluminum or of an Inconel® type alloy.

A misting nozzle 18 is attached to the device 1 at the exit opening 10 of said device.

The misting nozzles constitute nozzles known per se. These are nozzles allowing the generation of small droplets, for example with a size less than or equal to 50 μm, or even to 10 μm.

The misting nozzle 18 allows generating a fog comprising small liquid droplets of the extinguishing agent. One example of a usable misting nozzle is the nozzle sold under the reference "DFN Misting Nozzle" by the IC Spray company. This example of a nozzle allows generating liquid droplets of extinguishing agent of a size less than or equal to 50 μm at −10° C.

Figure 2:
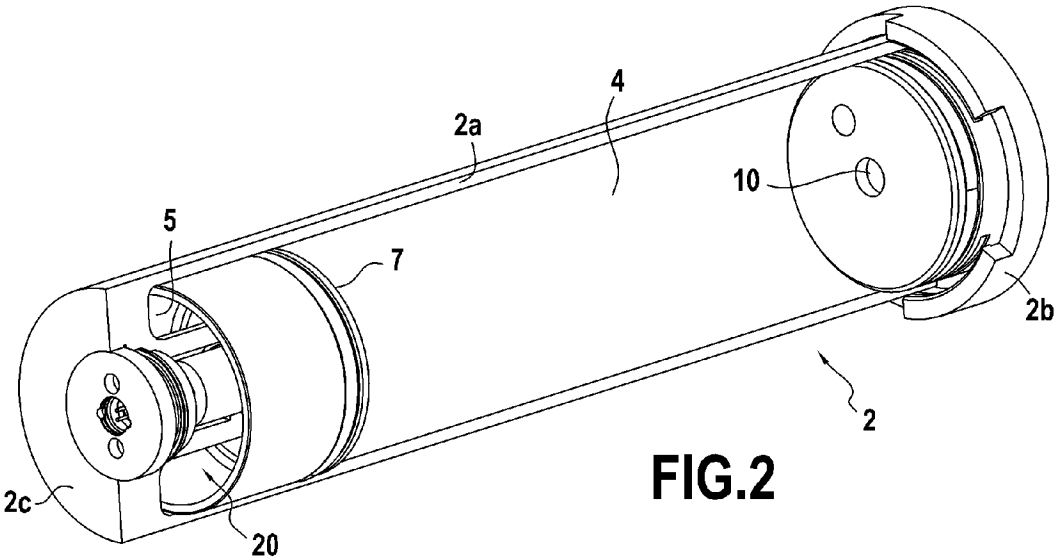
FIG. 2 is a perspective view of a portion of the extinguisher of FIG. 1, and FIGS. 3A and 3B show the displacement of the movable wall in the example of the extinguisher of FIG. 1 during the dispensing of the extinguishing agent.
Figure 3A:
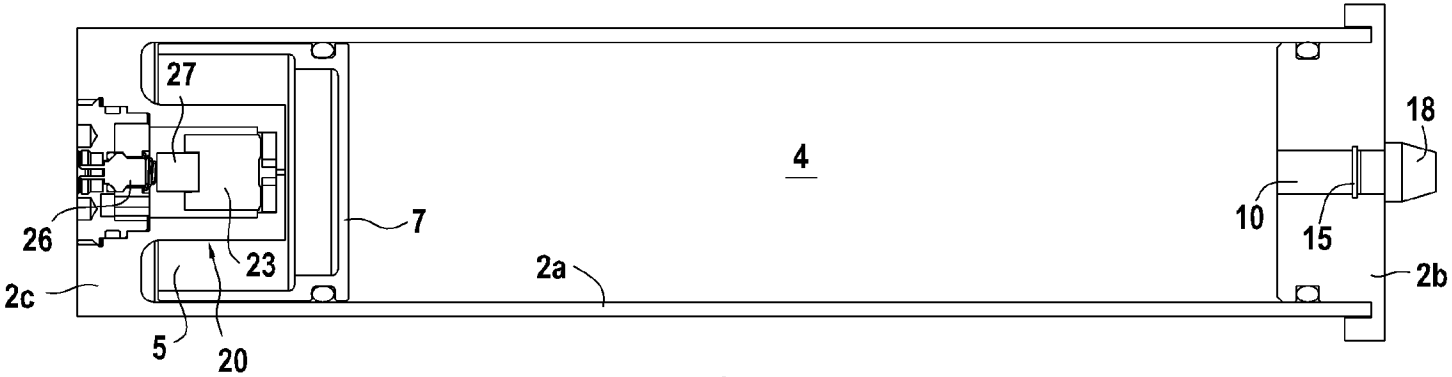

The method of dispensing the extinguishing agent by the example of a device illustrated in FIGS. 1 and 2 will now be described in connection with FIGS. 3A and 3B.

The gas generator 20 is actuated first of all in order to pressurize the chamber 5. This overpressure created in the chamber 5 is transmitted by the movable wall 7 to the extinguishing agent present in the storage chamber 4. Once a predefined value is attained for the pressure in the storage chamber 4, the diaphragm 15 passes into a second configuration allowing the departure of the extinguishing agent outside the body 2 through the exit opening 10.

Figure 3B:
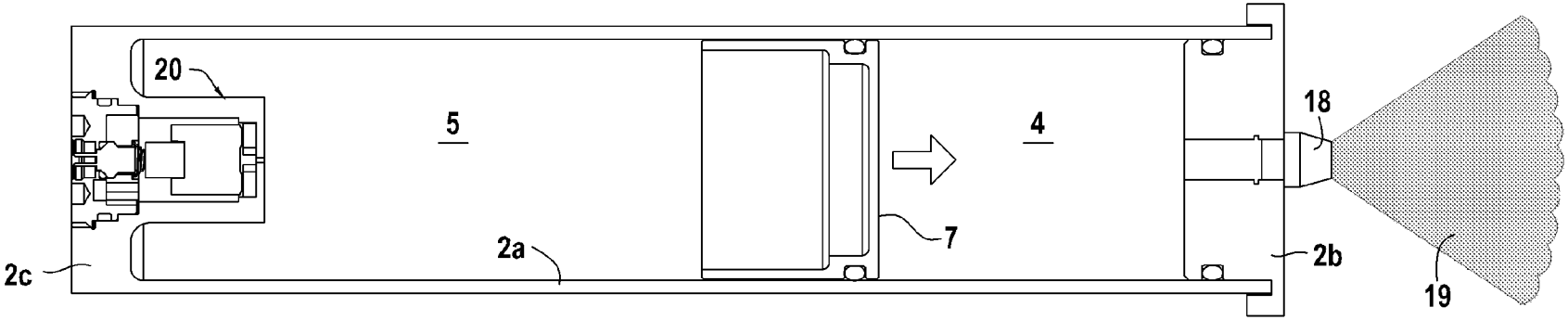

As illustrated in FIG. 3B, the movable wall 7 is set into motion toward the first bottom wall 2*b* in order to cause the dispensing of the extinguishing agent. The movable wall 7 is set into motion along the longitudinal axis X.

The extinguishing agent is dispensed outside the extinguisher by the misting nozzle 18 in order to obtain a fog 19 of fine liquid droplets of the extinguishing agent.

The fact of treating the fire by droplets in the liquid state allows better cooling of the fire by the vaporization of the droplets of the extinguishing agent (the liquid phase of the extinguishing agent has a high vaporization energy at low temperature). Better effectiveness of extinguishing at low temperature that at higher temperature is thereby obtained. Tests conducted on FK-5-1-12 have made it possible to demonstrate a significant reduction of the concentration necessary for extinguishing at low temperature, provided that a portion of the product is transported in liquid form into the fire zone.

As was described above, the extinguisher according to the invention is especially suited for extinguishing a fire at low temperature. However, it operates perfectly when it is used at higher temperatures. Under these conditions, the agent can conventionally be transported in gaseous form and it also extinguishes the fire in its gaseous form.

Moreover, it is possible to use the extinguisher in an environment at a pressure equal to 1 bar, or less than 1 bar.

During the dispensing of the extinguishing agent, the volume of the pressurization chamber 5 increases and the volume of the storage chamber 4 is reduced in the example illustrated. The sum of the volume of the pressurization chamber 5 and the volume of the storage chamber 4 is constant during the dispensing of the extinguishing agent. The movable wall 7 is configured to be displaced without deforming during the dispensing of the extinguishing agent. The movable wall 7 has a piston effect. The face of the movable wall 7 located on the side of the pressurization chamber 5 is subject to the pressure of the generated gas, this pressure is communicated to the face of the movable wall 7 located on the side of the storage chamber 4 in order to allow the dispensing of the extinguishing agent outside the body 2. The movable wall 7 causes, during its displacement, the dispensing of the extinguishing agent outside the body 2 in the manner of a syringe in the example illustrated.

An example where an extinguisher with a piston is used to allow dispensing the extinguishing agent has just been described; however, using another system without a piston, using for example a dip tube connecting the gas generator to the extinguishing agent, does not depart from the scope of the invention.

In addition, as indicated above, the invention can also be implemented with a bottle of pressurized gas, although the employment of a pyrotechnic generator is preferred.

The expression "comprised between . . . and . . . " must be understood to include the limits.

The invention claimed is:

1. A method for extinguishing a fire in an environment with a temperature less than or equal to 10° C., comprising at least one step of dispensing an extinguishing agent by a fire extinguisher comprising:

a body defining a storage chamber containing the extinguishing agent, a gas generator configured to pressurize the extinguishing agent in order to dispense it outside the body through an exit opening, the exit opening being equipped with a misting nozzle, and the extinguishing agent having a solidification temperature less than −10° C., a saturating vapor concentration of the extinguishing agent taken at −10° C. and 1 bar being less than an extinguishing concentration of the extinguishing agent determined according to the ISO 14520:2015, 3$^{rd}$ edition, standard for a heptane fire at 1 bar, and wherein the misting nozzle generates liquid droplets of extinguishing agent with a size less than or equal to 50 μm at −10° C., the extinguishing being ensured by a two-phase flow of the extinguishing agent prior to its contact with the fire zone.

2. The method according to claim 1, wherein the gas generator is configured to impose a maximum pressure on the extinguishing agent greater than or equal to 3 bar.

3. The method according to claim 2, wherein the gas generator is configured to impose a maximum pressure on the extinguishing agent greater than or equal to 7 bar.

4. The method according to claim 1, wherein the extinguishing agent is FK-5-1-12.

5. The method according to claim 1, wherein the gas generator comprises a pyrotechnic gas generator.

* * * * *